United States Patent [19]

Harding

[11] Patent Number: 4,606,839

[45] Date of Patent: Aug. 19, 1986

[54] SOLID SOAP AND A PROCESS FOR THE PRODUCTION THEREOF

[76] Inventor: John A. S. Harding, 893 Van Nijenrodeveg, Amsterdam, Buitenveldert, Netherlands

[21] Appl. No.: 696,496

[22] Filed: Jan. 30, 1985

[30] Foreign Application Priority Data

Feb. 6, 1984 [IT] Italy ..... 47652 A/84

[51] Int. Cl.[4] ..... C11D 9/04; C11D 13/10; C11D 17/00

[52] U.S. Cl. ..... 252/132; 252/107; 252/108; 252/130; 252/134; 252/DIG. 16

[58] Field of Search ..... 252/107, 108, 130, 132, 252/DIG. 16, 134

[56] References Cited

U.S. PATENT DOCUMENTS

| | | | |
|---|---|---|---|
| 2,177,055 | 10/1939 | Cranor | 252/108 |
| 2,193,329 | 3/1940 | Curzon | 252/132 |
| 2,202,741 | 5/1940 | Maxwell | 252/130 |
| 2,300,413 | 11/1942 | Gaver | 252/369 |
| 2,664,399 | 12/1953 | Kluender | 252/109 |
| 2,845,391 | 7/1958 | Searle | 252/539 |
| 2,982,735 | 5/1961 | Blinka et al. | 252/132 |
| 3,494,869 | 2/1970 | Armstrong | 252/109 |
| 3,673,256 | 6/1972 | Pieper et al. | 252/132 X |
| 3,798,181 | 3/1974 | Vazquez | 252/539 |
| 3,941,711 | 3/1976 | Gipson | 252/117 |
| 4,097,407 | 6/1978 | Ady | 252/370 |
| 4,100,097 | 7/1978 | O'Roark | 252/145 |
| 4,207,198 | 6/1980 | Kenkare | 252/117 |

FOREIGN PATENT DOCUMENTS 007977 3/1970 Japan .

OTHER PUBLICATIONS

American Heritage Dictionary, Second Edition Houghton Mifflin Co., Boston, 1982, p. 1052.

Martin G., "The Modern Soap & Detergent Industry," vol. II, The Manufacture of Special Soaps & Detergent Compositions, The Technical Press Ltd., London, 1951, Chap. V, II, VII, 33,34.

Soap Perfumery & Cosmetics, "Starch as a Filler," Mar. 1939, p. 266.

*Primary Examiner*—Prince E. Willis

*Attorney, Agent, or Firm*—Cushman, Darby & Cushman

[57] ABSTRACT

A solid soap is described composed of a hard and elastic gel based on starch, potassium and sodium salts of higher fatty acids and water.

The soap as herein described has the same detergent capacity as other soap known at the present state of the art, but it is remarkably less expensive and it has a favorable effect on the skin.

12 Claims, No Drawings

SOLID SOAP AND A PROCESS FOR THE PRODUCTION THEREOF

BACKGROUND OF THE INVENTION

The present invention relates to a solid soap composed mainly of a hard and elastic gel of corn starch—soap—water, and its relevant manufacturing process.

Conventional solid soaps are normally composed of about 85% anhydrous soap (mainly sodium salts of higher fatty acids) 10–13% water and the usual additives.

The soaps composed according to these formulae have several drawbacks. In fact a great part of the active ingredient (soap in this case, and up to 50% of it) is useless for detergency, so causing high production costs.

Moreover this excess of active ingredient is harmful because of the excessive degreasing action on the skin (the so-called alkaline effect). On the other hand attempts to overcome the drawback of the high cost through use of soap containing higher water contents did not give positive results. In fact these soaps when used, produced abundant slough, undergoing at the same time a loss in firmness.

Several types of additives, drying materials and fillers were tried in the attempt to overcome these drawbacks. One of these materials is starch, which is known as a filler. The addition of starch made in the previous techniques was made in such a way as to prevent the formation of gels and dextrins because of possible difficulties in the making and finishing of the product.

It has now been surprisingly found that a soap including a hard and elastic gel composed of:

starch, 8 to 28% by weight, water, 10 to 60% by weight, sodium and potassium salts of higher fatty acids, 24 to 54% by weight, can overcome the above mentioned drawbacks.

Gels are rigid or semi-rigid colloids that contain high quantities of liquid substance, usually water, and in which the constituent particles are bonded together in reticular structures. Gels can therefore be considered as solid matter, more or less plastic. Then can be classified into two classes, elastic and non-elastic. Partial desolvation of the first ones brings about the formation of an elastic solid, while in the second class, partial desolvation brings about a loss of elasticity and possible pulverization and/or vitrification of the gel.

Soaps are generally alkaline salts (sodium and potassium) of higher fatty acids (lauric, myristic, palmitic, oleic, stearic and others). They are formed by the reaction (saponification) of the esters of the fatty acids with glycerol and alkalies. These soaps can be classified as: soft soaps, derived from reaction with potassium alkalies, hard soaps, derived from reaction with sodium alkalies.

Starch is a carbohydrate made by molecules with linear or branched chains, mainly associated in micelles by hydrogen bonds or molecular water bridges.

By supplying heat to a suspension of water and starch, the reticular structure of starch weakens because of disruption of the hydrogen bonds. Heat brings about hydrolysis of the micelles and therefore an irreversible gelatinization together with the swelling of the micelles due to the water molecules becoming attached to the liberated hydroxyl groups. It is also known that if this reaction is carried out together with fatty acids or soaps containing fatty acids, the latter form complexes with the linear fraction of the starch, so creating cross bonds between macromolecules, bonds which reinforce remarkably the gel structure.

SUMMARY OF THE INVENTION

The object of the present invention is therefore a solid soap comprising a hard and elastic gel composed of:

starch, 8 to 28% by weight, sodium and/or potassium salts of higher fatty acids, 24 to 54% by weight, water, 10 to 50% by weight.

The very large variability of the percentages of the three components depends upon the capacity of the starch to hold water in small or large quantity, and because of the fact that the gel starch-water can be modified by adding sodium or potassium soaps within the above limits bringing about a hard and elastic gel.

It is obvious that the characteristics of the final gel (hardness, elasticity, detergency, effect on the skin, foaming capacity etc.) will vary, even if not linearly, with the relative amounts of the above three components and with the ratio $Na^+$ Soap/$K^+$ Soap.

It was also found that boric acid or sodium borate have a favourable effect on the strength of the gel.

Therefore object of the present invention is also the use of boric acid or sodium borate in the above described solid soap in amounts that can vary from 0.05% to 5% by weight of the total weight of the composition. The soap described in the present invention can also include the additives and the auxiliary materials normally used in soap compositions.

Lastly a further object of the present invention is a process to produce the above described solid soap that includes the following operations:

(a) mixing starch, water, sodium and potassium salts of the higher fatty acids to obtain a liquid suspension;

(b) heating and mixing at a temperature between 60° and 100° C. the mixture (a) to obtain, after gelatinization of the starch, a semi-fluid paste with a water content between 48 and 52% by weight;

(c) heating the paste (b) further to a temperature ranging from 90° C. to 160° C. to obtain, after a second stage of gelatinization, a denser paste with a gel structure having a higher strength than that of paste of phase (b), the water content being now between 45 and 49% by weight.

The drawbacks of the conventional solid soaps, as described above, are overcome by the solid soaps object of this invention. These new soaps are capable of a very efficient detergent performance and, because of their high starch content, do not show any of the harmful consequences on the skin due to the alkaline effect. On the contrary, they have a favourable dermatological effect just because of the well known beneficial effect of the starch on the skin.

Moreover the soaps object of this invention are much less expensive than these known at the present state of the art because of the lower soap content and because of their very high water content. Moreover because of their peculiar gel structure that holds firmly the water therein contained, these soaps have no tendency to form slough during their use.

While the soaps object of this invention are particularly suited for the use as toilet soaps because of the above characteristics they can be used to advantage also as laundry soaps.

It is obvious that appropriate proportions of the components are very important to optimize the following variables:

- obtainment of a hard and elastic gel with a minimum supply of heat;
- low consumption of the product in use;
- resistance to water;
- dermatologic characteristics of the product taking into account the favourable effect of the starch and the unfavourable effect of the soap;
- capacity of bonding large amounts of water to the gel;
- characteristics of foam, appearance, pleasant feeling to the touch;
- capacity to include several additives such as, for instance, perfumes and colouring matters without weakening the gel structure.

Therefore the proportion of the components can easily be determined by an expert through preliminary tests in order to adjust the composition to the changing requirements of the market.

The starch preferably used is corn starch, without limiting with this preference the possible use of other types of starch.

The soap preferably used is soap from coconut oil, that can be replaced by any other type of soap, for instance a soap from palm kernel oil. Hereunder the average compositions (as % by weight) of coconut oil and palm kernel oil are reported:

| | | Coconut oil | Palm kernel oil |
|---|---|---|---|
| Saturated acids: | | | |
| Caproic acid | $C_6H_{12}O_2$ | traces | traces |
| Caprylic acid | $C_8H_{16}O_2$ | 8.0 | 2.7 |
| Capric acid | $C_{10}H_{20}O_2$ | 7.0 | 7.0 |
| Lauric acid | $C_{12}H_{24}O_2$ | 48.0 | 46.9 |
| Myristic acid | $C_{14}H_{28}O_2$ | 17.5 | 14.1 |
| Palmitic acid | $C_{16}H_{32}O_2$ | 8.8 | 8.8 |
| Stearic acid | $C_{18}H_{36}O_2$ | 2.0 | 1.3 |
| Unsaturated acids: | | | |
| Oleic acid | $C_{18}H_{34}O_2$ | 6.0 | 18.5 |
| Linoleic acid | $C_{18}H_{32}O_2$ | 2.5 | 0.7 |

A mixture of sodium and potassium soaps is preferred, having the proportions 100 to 0 $Na^+/K^+$ up to 30 to 70 $Na^+/K^+$ the higher the amount of $K^+$ soap, the lesser the firmness of the product, the higher the difficulty in handling and finishing, the higher the quantity of foam and its rapidity of formation.

Auxiliary materials can be used as well as additives to improve the characteristics of the product or to better adjust it to the market requirements.

For instance, sodium carboxymethylcellulose, polyvinyl alcohols of any degree of substitution (PVA), resin, formalin or proteins can be added. Other materials, ways and amounts of usage in the formula are well known by soap experts. These materials can be used in the proportions:

| | |
|---|---|
| sodium carboxymethyl cellulose | 0.1 to 10% by weight |
| polyvinyl alcohol | 0.1 to 5% by weight |
| resin (rosin) | 0.1 to 5% by weight |
| protein (e.g. gelatin) | 0.1 to 5% by weight |
| formalin | 0.0 to 0.1% by weight" |

EXAMPLE 1

Here follows a typical initial composition to be processed according to the process also an object of the present invention.

| Composition 1: | % by weight |
|---|---|
| $Na^+$ soap from coconut oil, 36% solids content in water | 63.66 |
| $K^+$ soap from coconut oil, 38% solids content in water | 9.84 |
| boric acid, 5% solution in water | 1.74 |
| sodium chloride, 100% solids (from the above wet soaps) | 1.04 |
| sodium chloride, 20% solution in water | 3.47 |
| industrial water | 4.17 |
| stearic acid | 0.35 |
| corn starch, 90% solids in water | 15.63 |
| formalin, 30% solution in water | 0.10 |
| | 100.00 |

The composition of the soap at the end of the whole manufacturing process is the following:

| Composition 2: | % by weight |
|---|---|
| sodium soap from coconut oil | 28.84 |
| potassium soap from coconut oil | 4.70 |
| sodium borate, 100% | 0.10 |
| sodium chloride, 100% | 2.18 |
| stearic acid, 100% | 0.44 |
| corn starch, 100% solids | 17.70 |
| formalin, 100% | 0.04 |
| water | 46.00 |
| | 100.00 |

The formalin used is a preservative that can be replaced by other ones known and normally used in the manufacturing of conventional soaps.

The composition 2 can be dried to obtain a soap containing up to 10% moisture, so increasing proportionally all the other components. This drier product is different in respect of the composition 2 because of its greater hardness, slower consumption rate, easier finishing and wrapping, higher softening point.

EXAMPLE 2

Manufacturing Process

In order to explain the manufacturing process, the composition 1 is taken as an example and processed to obtain composition 2.

The manufacturing process starts in kettle fitted with an agitator in which the following materials are added in the order:

- water;
- wet soap obtained by the normal soap making process;
- boric acid solution.

The mixture is heated at a temperature ranging from 60° to 95° C. and the pH is adjusted with chlorhydric acid and/or citric acid up to a value of 9. Sodium citrate, melted or powdered stearin, starch and formalin solution are added in the order. The first stage of gelatinization is almost immediate; the liquid suspension becomes in few minutes a non-dense paste. This stage, carried out for about 10 minutes with constant stirring, brings about a paste which becomes denser with time. After 30 minutes maximum, there is no more increase in firmness of the paste.

At this point of the manufacturing process the water content is about 50%. The paste is heated up to 100° to 150° C. for instance milling it in a heated roll-mill for a time between 10 and 30 minutes. What is important is the heating, not the physical action of milling the soap. A second phase of gelatinization takes place here and it brings about a paste much denser and firmer than that obtained after the first heating treatment.

The paste now is smooth and manageable. The water content is about 47%.

EXAMPLE 3

Addition of the Perfume

The paste obtained in the previous example is transferred in a mixer fitted with a double blade agitator (about 40 r.p.m.) and cooled down to 40° to 60° C. At this temperature the perfume is added. Following immediately the addition of the perfume, the paste undergoes a marked loss in firmness, becoming very soft and tacky. The constant stirring of the mass is continued and after about 5 minutes the paste goes back to its former state of non-tacky firmness. The paste is now in a condition to be extruded, pressed and wrapped as a normal soap. Its water content is about 46%, and it is ready for packing.

The softening point of the product at 46% moisture is between 45° and 50° C. However, this negative characteristic can be improved by decreasing the water content of the product, that can be carried out in a normal soap drier before the addition of perfume. To raise the softening point, the content in sodium chloride and/or sodium citrate can be increased, keeping it in the necessary limits to prevent "whitewashing" of the finished soap, that is migration of mineral salts from the inner part of the soap towards the surface.

EXAMPLE 4

Aging and Wrapping the Product

The third gelatinization phase takes place during the aging of the product: hardness and elasticity of the product increase following an asymptotic curve which reaches the nearly flat part after 48 hours aging. At this stage the gel has reached its final structure. The soap cake is now a solid mass with a smooth surface, pleasant to touch, elastic. If heated beyond 50° C. it becomes soft, but upon aging at lower temperatures it goes back to the previous structural conditions.

The manufacturing process, the machinery and the plants described above can be changed by an expert of these techniques, to improve the efficiency of the process. However, in order to obtain the product described above it is essential that the liquid mixture and the paste after the first gelatinization phase be homogeneously heated up to complete gelatinization of the starch. Mechanical working of the paste is necessary for an even distribution of the heat, but it has little or no effect on the gel structure. On the contrary, an excess of mechanical working of the paste in the roll-mills can damage the structure of the gel starch-water due to the "shearing" effect.

The product should be packed in a water-proof film to prevent high moisture loss. The wrapped soap should be contained in a hard case to allow storage in places and warehouses where the room temperature can be high.

The quality of the product so obtained is remarkably superior to that of a conventional toilet soap. This better quality derives both from the product's peculiar physical-chemical structure, and from the intrinsic characteristics of the materials used. In fact consumer tests proved for certain that this product is better than the conventional soaps for effect on the skin, quantity and type of foam, rinsing, feeling when wet and dry. Its superiority is also evident because of its capacity of not producing slough in the soap-dish, notwithstanding the very high water content. It has been also remarked that some of the consumers, who are allergic to conventional soaps, used this product without ill effects. Finally, the production cost is remarkably inferior to that of normal soaps.

I claim:

1. A solid soap in the form of a hard, elastic gel, non-slough, non-irritant, high-foaming, consisting essentially of: water in the range 10 to 60%; starch in the range 8 to 28%; sodium and potassium salts of higher fatty acids in the range 24 to 54%; the potassium salts of higher fatty acids being in the range 0 to 70% of the total of sodium and potassium, being bonded together in a chemical complex which has the capacity of absorbing water during use without formation of slough.

2. A solid soap according to claim 1 containing 45 to 49% water.

3. The solid soap according to claim 1, further comprising boric acid or its sodium salt between 0.05% and 5% by weight of the total weight of the formula.

4. The solid soap according to claim 3, further comprising sodium chloride and/or sodium citrate between 0.01% and 5% by weight of the total weight of the formula.

5. The solid soap according to claim 4, further comprising stearin between 0.1% and 10% by weight of the total weight of the formula.

6. The solid soap according to claim 5, further comprising colouring matters and perfumes.

7. The solid soap according to claim 6, consisting essentially of percent by weight:

| | |
|---|---|
| sodium soap from coconut oil | 28.84 ± 5.00 |
| potassium soap from coconut oil | 4.70 ± 0.50 |
| sodium borate | 0.10 ± 0.01 |
| sodium chloride | 2.18 ± 0.20 |
| stearin | 0.44 ± 0.05 |
| corn starch | 17.70 ± 2.00 |
| formaldehyde | 0.04 — |
| water | 46.00 ± 5.00 |
| | 100.00 |

8. A solid soap according to claim 3 wherein the boric acid or its sodium salt is present in an amount of 0.10 to 0.01%.

9. A solid soap according to claim 1 containing 28.84±5.00% sodium soap and 4.70±0.50% potassium soap by weight.

10. A process for the production of a solid soap as defined in claim 1, consisting essentially of:

(a) mixing to a liquid solution 15 to 70% in weight of sodium and potassium salts of higher fatty acids and 30 to 85% by weight of water;

(b) while mixing, heating the solution under (a) homogeneously and stirring at a pH 8 to 10, up to a temperature between 60° and 110° C. for 5 to 25 minutes, then adding starch in the quantity of 8 to 28% by weight of the total weight of the mixture, so as to obtain, after gelatinization, the formation of a semi-fluid paste with a water content of 48 to 52% by weight;

(c) submitting the paste under (b) to further heat treatment at a temperature between 90° and 160° C. for 10 to 40 minutes so as to have, after further gelatinization, a denser paste than the paste under (b) with a water content of 45–49% by weight.

11. The process producing the soap as defined in claim 6, consisting essentially of:

(a) mixing to a liquid solution 15 to 70% by weight of sodium and potassium salts of higher fatty acids, 30 to 85% in weight of water, 0.05 to 5% by weight of boric acid or its sodium salt;

(b) while mixing, heating the solution under (a) homogeneously and stirring, up to a temperature between 60° and 110° C. for 5 to 25 minutes, adjusting the pH to a value between 8 and 10; then adding sodium chloride and/or sodium citrate between 0.01 and 5% by weight, stearin between 0.1 and 10% by weight, starch between 8 and 28% by weight, referring to the weight of the final composition, so as to obtain, after gelatinization, the formation of a semi-fluid paste containing 48 to 52% by weight of water;

(c) submitting the paste under (b) to further heat treatment at a temperature between 90° and 160° C. for 10–40 minutes so as to have, after further gelatinization, a denser paste than the paste under (b) with a water content between 45 and 49% by weight;

(d) adding to the paste under (c) perfumes and/or colouring matters.

12. The process according to claim 11, further comprising during phase (c) a mechanical milling in heated roll-mills.

* * * * *